US008025186B2

(12) United States Patent
Lee et al.

(10) Patent No.: US 8,025,186 B2
(45) Date of Patent: Sep. 27, 2011

(54) REFRIGERATOR AND METHOD OF CONTROLLING THE SAME

(75) Inventors: Seung Lee, Gwangju (KR); Doo Lee Kim, Gwangju (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 895 days.

(21) Appl. No.: 12/002,761

(22) Filed: Dec. 19, 2007

(65) Prior Publication Data

US 2008/0196422 A1 Aug. 21, 2008

(30) Foreign Application Priority Data

Feb. 16, 2007 (KR) ..... 10-2007-0016563

(51) Int. Cl.
*B67D 7/80* (2010.01)

(52) U.S. Cl. ..... 222/146.6; 62/389

(58) Field of Classification Search ..... 222/146.6, 222/146, 1, 182, 530–538, 129, 129.1, 639–642; 62/389–400, 98
See application file for complete search history.

(56) References Cited

U.S. PATENT DOCUMENTS 3,969,909 A * 7/1976 Barto et al. ..... 62/179
4,543,800 A * 10/1985 Mawby et al. ..... 62/339
4,912,942 A * 4/1990 Katterhenry et al. ..... 62/338
5,263,509 A * 11/1993 Cherry et al. ..... 137/343
5,359,795 A * 11/1994 Mawby et al. ..... 40/405
6,182,453 B1 * 2/2001 Forsberg ..... 62/125
7,007,500 B2 * 3/2006 Lee ..... 62/389
2006/0144066 A1 * 7/2006 Lee et al. ..... 62/238.6
2006/0196212 A1 * 9/2006 Jenkins et al. ..... 62/340
2007/0251261 A1 * 11/2007 Son et al. ..... 62/390
2008/0104978 A1 * 5/2008 Kim ..... 62/150
2008/0258597 A1 * 10/2008 Kwon et al. ..... 312/405.1

FOREIGN PATENT DOCUMENTS

KR 92-010367 11/1992
KR 10-0232851 9/1999

* cited by examiner

*Primary Examiner* — Lien Ngo

(74) *Attorney, Agent, or Firm* — Staas & Halsey LLP

(57) ABSTRACT

Disclosed are a refrigerator for discharging water contained in a water tank when a predetermined time has passed to supply fresh water to a user and a method of controlling the same. The refrigerator includes a main body, a door pivotally mounted to the main body, a dispenser provided in the door to dispense water to the exterior, a water tank connected to the dispenser to accommodate the water, a water supply valve connected to the water tank to control a flow of the water to be supplied to the water tank, and a controller connected to the water supply valve and the dispenser to control the same and to discharge the water to the exterior when the water is accommodated in the water tank for a predetermined time.

17 Claims, 8 Drawing Sheets

REFRIGERATOR AND METHOD OF CONTROLLING THE SAME

CROSS-REFERENCE TO RELATED APPLICATIONS

This application claims the benefit of Korean Patent Application No. 2007-16863, filed on Feb. 16, 2007, in the Korean Intellectual Property Office, the disclosure of which is incorporated herein by reference.

BACKGROUND

1. Field

The present invention relates to a refrigerator and a method of controlling the same, and more particularly, to a refrigerator capable of discharging water contained in a water tank thereof when a predetermined time has passed to supply fresh water to a user, and a method of controlling the same.

2. Description of the Related Art

In a conventional refrigerator, a freezer compartment and a refrigerator compartment are provided to refrigerate or freeze accommodated goods. However, recently, a dispenser has been mounted in a refrigerator so that a user takes out water or ice accommodated in the freezer compartment.

As described above, in order for the user to take out the water, a water tank to accommodate the water is provided in the rear side of the freezer compartment so that fresh and cold water is fed to the dispenser. A water source that supplies the water to the water tank is provided outside a main body of the refrigerator.

Moreover, water supplying pipes are respectively provided between the water source and the water tank and between the water tank and the dispenser. In particular, a filter to filter the water and a water supply valve to control the water flow are provided in the water supply pipe between the water supply source and the water tank.

Therefore, when the user operates an actuator lever in the dispenser using a cup, the water supply valve is opened so that water flows from the water supply source to the water tank and the water previously accommodated in the water tank is pushed by the newly supplied water to flow to the dispenser and to be discharged into the cup that presses the actuator lever.

However, when the user is away from home for a long time so that the dispenser of the refrigerator does not operate for a long time, the water is contained in the water tank for a long time so that the freshness of the water deteriorates.

SUMMARY

Accordingly, it is an aspect of the present invention to solve the above-mentioned problems. Another aspect of the present invention is to provide a refrigerator capable of automatically discharging stale water which is accommodated for a predetermined time and the freshness thereof has deteriorated, and supplying new fresh water in order to prevent the freshness of the water provided to a user from deteriorating, and a method of controlling the same.

Additional aspects and/or advantages will be set forth in part in the description which follows and, in part, will be apparent from the description, or may be learned by practice of the invention.

Accordingly, it is an aspect of the present invention to provide a refrigerator comprising: a main body; a door pivotally mounted to the main body; a dispenser provided in the door to dispense water to an exterior of the refrigerator; a water tank connected to the dispenser to accommodate the water; a water supply valve connected to the water tank to control a flow of the water to be supplied to the water tank; and a controller connected to the water supply valve and the dispenser to control the water supply valve and to discharge the water to the exterior when the water is accommodated in the water tank for a predetermined time.

Moreover, the refrigerator further comprises a guide pipe provided at a lower side of the dispenser to guide the water to be discharged from the dispenser.

The refrigerator further comprises a water collecting tray provided at a lower side of the main body and connected to the dispenser through the guide pipe to collect the water discharged from the dispenser.

The refrigerator further comprises a water collecting container at an upper side of the guide pipe to receive the water discharged from the dispenser, and a lower side of the water collecting container is connected to the guide pipe.

The guide pipe is provided in the door.

The refrigerator further comprises a water source provided outside the main body to supply the water into the main body, a water supply pipe provided in the main body to connect the dispenser, the water tank, and the water source to each other, and a flow rate sensor provided in the water supply pipe and connected to the controller to detect whether the water flows in the water supply pipe and measure a flow rate of the water.

The refrigerator further comprises a level sensor provided in the water collecting tray to detect a level of the water accommodated in the water collecting tray.

The refrigerator further comprises an alarm connected to the controller to generate an alarm signal when the level of the water accommodated in the water collecting tray is equal to or higher than a predetermined level.

The refrigerator further comprises a display connected to the controller to display an alarm signal when the level of the water accommodated in the water collecting tray is equal to or higher than a predetermined level.

The refrigerator further comprises a drain pipe provided in the main body to be connected to the guide pipe and to a drain hole formed at the exterior of the refrigerator.

The foregoing and/or other aspects of the present invention are also achieved by providing a method of controlling a refrigerator comprising a dispenser, a water tank connected to the dispenser to accommodate water, and a water supply valve to supply water to the water tank, the method comprising: determining how long the water is accommodated by detecting a change of a flow rate of the water accommodated in the water tank; and discharging the water to an exterior of the refrigerator when the water is accommodated for a predetermined time.

Moreover, the method of controlling a refrigerator further comprises: determining a level of the water discharged to a water collecting tray to collect the water discharged from the dispenser; and stopping the discharge of the water when the determined level of the water reaches a predetermined level.

The method of controlling a refrigerator further comprises alarming a user that the level of the water is equal to or higher than the predetermined level when the level of the water discharged to the water collecting tray reaches the predetermined level.

It is determined whether the user takes out the water collecting tray, stopping the alarming when the water collecting tray is taken out, and continuing the alarming when the water collecting tray is not taken out.

A level of the water accommodated in a water collecting tray to collect the water discharged from the dispenser is determined, and when the determined level of the water is less than a predetermined level, activating the water supply valve to supply new water equal to a quantity of the discharged water such that the previously accommodated water is discharged by the new water.

It is determined whether the discharge of the water is complete, and stopping the discharge of water and closing the water supply valve when the discharge of the water is completed.

The method of controlling a refrigerator further comprises determining whether an automatic water discharging mode or a manual water discharging mode is selected prior to the determining how long the water is accommodated, further comprising the determining how long the water is accommodated and the discharging of the water when the automatic water discharging mode is selected, and discharging the water to the exterior until a stopping command is inputted when the manual water discharging mode is selected.

BRIEF DESCRIPTION OF THE DRAWINGS

These and/or other aspects and advantages of the invention will become apparent and more readily appreciated from the following description of the embodiments, taken in conjunction with the accompanying drawings in which.

DETAILED DESCRIPTION OF THE EMBODIMENTS

Figure 1:
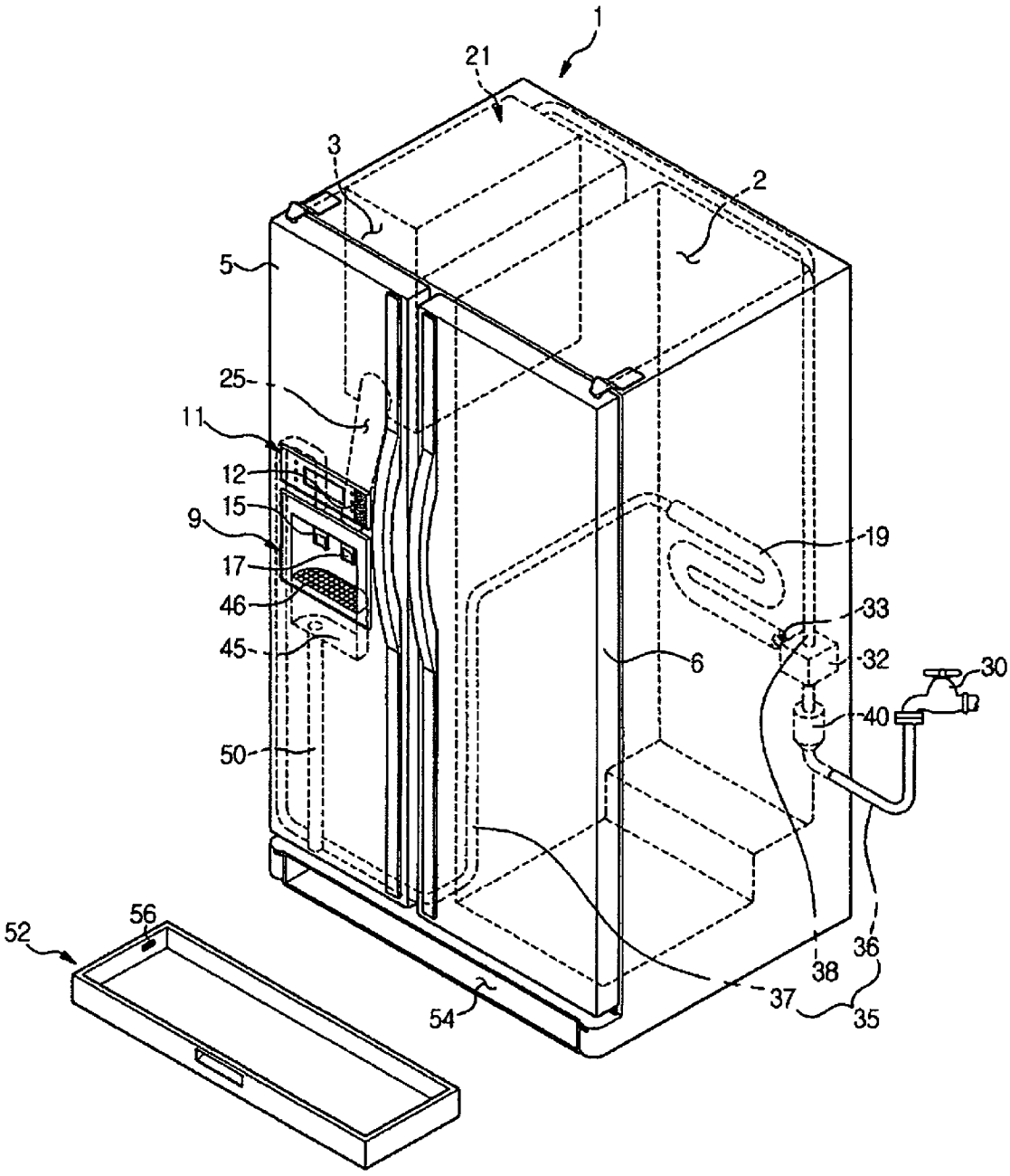
FIG. 1 is a perspective view illustrating a refrigerator according to an embodiment of the present invention.

Reference will now be made in detail to the embodiments, examples of which are illustrated in the accompanying drawings, wherein like reference numerals refer to the like elements throughout. The embodiments are described below to explain the present invention by referring to the figures.

As illustrated in FIG. 1, a refrigerator according to an embodiment of the present invention includes a main body 1 in which a refrigerator compartment 2 and a freezer compartment 3 are partitioned off from each other and a freezer compartment door 5 and a refrigerator compartment door 6 pivotally provided to the main body 1 to open and close the refrigerator compartment 2 and the freezer compartment 3, respectively. The refrigerator compartment door 5 and the freezer compartment door 6 form an external appearance of the refrigerator.

A dispenser 9 is provided in the front side of the freezer compartment door 5 such that a user can take out ice or water from the dispenser. A display 11 that displays the operation state of the refrigerator is provided at the upper side of the dispenser 9. An alarm 12 that warns of the malfunction of the refrigerator is provided to a side of the display 11.

A water dispensing lever 15 to dispense the water from the dispenser 9 and an ice dispensing lever 17 to dispense the ice from the dispenser 9 are provided to the dispenser 9. A water tank 19 is connected to the water dispensing lever 15 to accommodate the water. An ice making chamber 21 is connected to the ice dispensing lever 17 to make the ice.

The ice making chamber 21 is provided in the freezer compartment 3. An ice feeder 25 that feeds the ice is provided between the ice making chamber 21 and the dispenser 9.

The water tank 19 is provided in the rear side of the refrigerator compartment 2 so that the water is accommodated in a state of being refrigerated. The water tank 19 and the ice making chamber 21 are connected to a water source 30 provided outside the main body 1 by a water supply pipe 35.

A water supply valve 32 that controls the water flow is provided in front of an entrance of the water tank 19. The water supply pipe that connects the water tank 19 and the water supply source 30 to each other is referred to as a first water supply pipe 36. The water supply pipe that connects the water tank 19 and the dispenser 9 to each other is referred to as a second water supply pipe 37. The water supply pipe that connects the water supply valve 32 and the ice making chamber 21 to each other is referred to as a third water supply pipe 38.

A filter 40 that filters foreign substances contained in the water and a flow rate sensor 33 that determines the flow rate and the change in the flow of the water entering the water supply valve 32 and the water tank 19 are provided in the first water supply pipe 36. The water supply valve 32 controls the flow of the water into the ice making chamber 21 or the water tank 19 or distributes water supply.

A water collecting container 45 is provided at the lower side of the dispenser 9 to collect the useless water or ice pieces, discharged by the water dispensing lever 15 or the ice dispensing lever 17. A lattice-shaped lid 46 is provided on the water collecting container 45 such that the water or ice is smoothly introduced into the water collecting container 45.

A guide pipe 50 connected to the water collecting container 45 is provided at the lower side of the water collecting container 45 and extends to the lower side of the freezer compartment door 5. A water collecting tray 52 is provided at the lower side of the guide pipe 50 to be inserted into the lower side of the main body 1.

Therefore, when the water or ice discharged from the dispenser 9 is introduced into the water collecting container 45, the water or ice is fed to the guide pipe 50 by gravity and is guided by the guide pipe 50 to be collected in the water collecting tray 52.

The water collecting tray 52 is detachably provided in an inserting unit 54 provided in the lower front side of the main body 1 in the form of a drawer. When the water in the water collecting tray 52 reaches a predetermined quantity, the user takes out the water collecting tray 52 to throw away the water to the outside. A level sensor 56 that detects the level of the water is provided in the water collecting tray 52.

Figure 2:
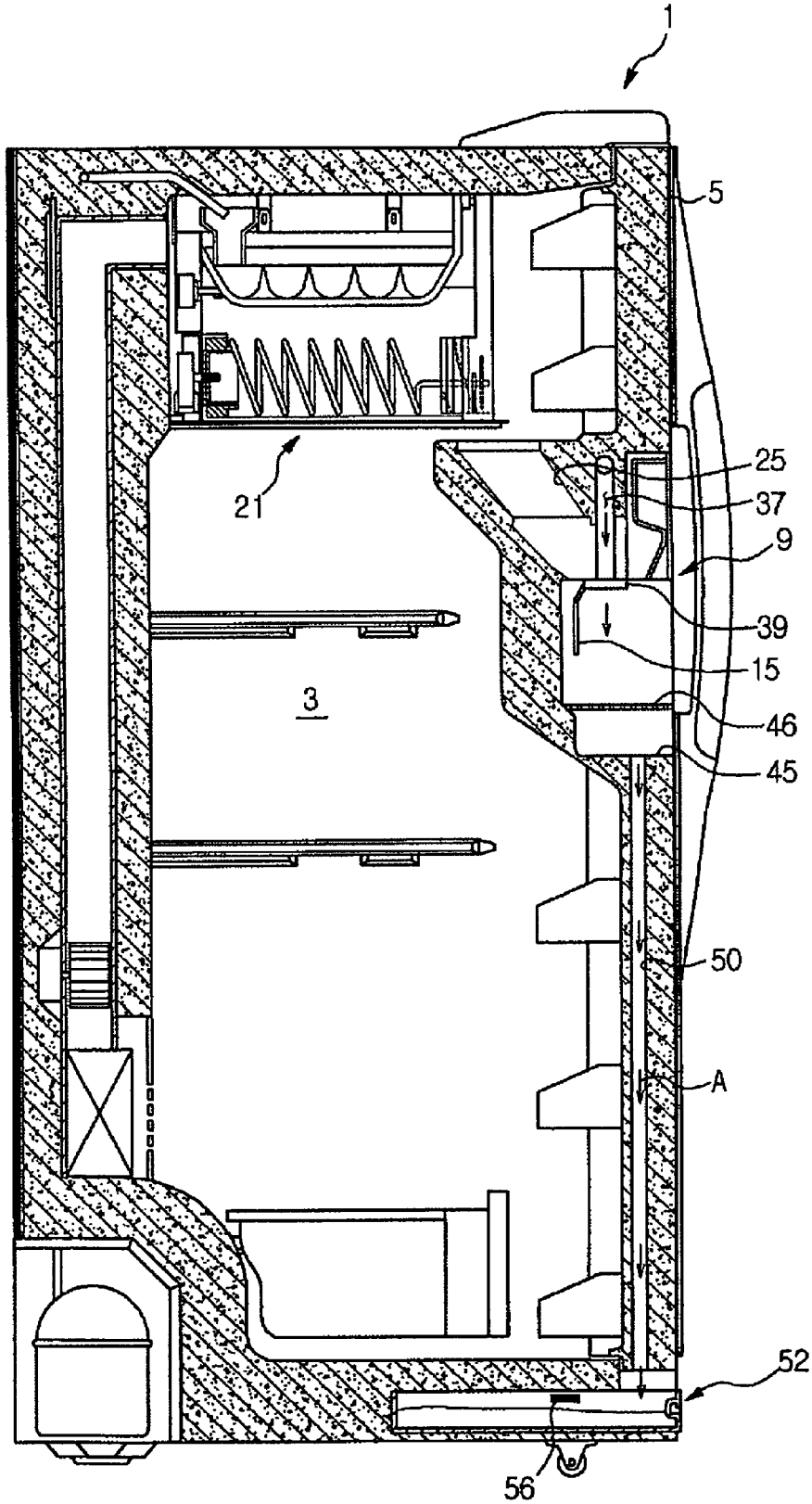
FIG. 2 is a side-sectional view illustrating the refrigerator according to the embodiment of the present invention of FIG. 1.

As illustrated in FIG. 2, the dispenser 9 is positioned in the central area of the freezer compartment door 5 and the second water supply pipe 37 is disposed on one side of the dispenser 9.

The second water supply pipe 37 is connected to a dispensing hole 39 from which the water is dispensed. The water collecting container 45 is disposed below the dispensing hole 39. The guide pipe 50 is provided at the lower side of the water collecting container 45 and extends to the upper side of the water collecting tray 52 along the lower part of the freezer compartment door 5.

On the other hand, the level sensor 56 is provided on one side of the inner wall of the water collecting tray 52 and is upwardly spaced away from the bottom of the water collecting tray 52 to detect the level of the water discharged from the dispenser 9, guided by the guide pipe 50 and introduced into the water collecting tray 52.

The arrows A of FIG. 2 indicate the flow direction of the water toward the water collecting tray 52. The flow of the water will be described later.

Figure 3:
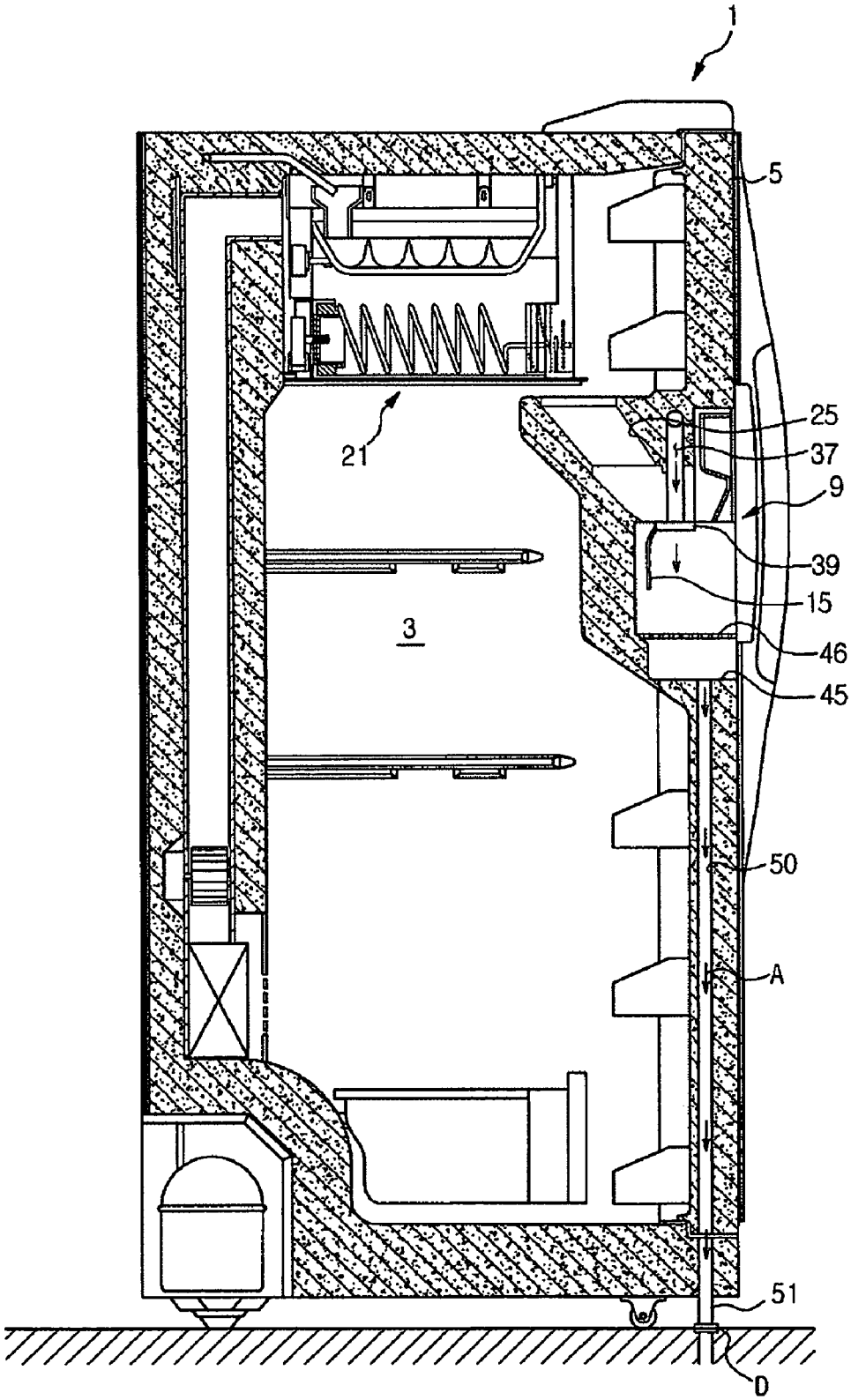
FIG. 3 is a side-sectional view illustrating a refrigerator according to another embodiment of the present invention.

FIG. 3 is a side-sectional view of a refrigerator according to another embodiment of the present invention. Most components of the refrigerator of FIG. 3 are the same as the components of the refrigerator according to the embodiment of FIG. 2. However, the water collecting tray 52 of FIG. 2 is not present in the refrigerator according to the embodiment of FIG. 3. Instead, a drain pipe 51 provided in the lower side of the main body 1 is connected to the guide pipe 50 and is connected to a drain hole D formed on the floor where the main body 1 is placed.

Therefore, the water discharged from the dispenser 9 is guided by the guide pipe 50 and the drain pipe 51 to be directly discharged to the drain hole D.

Figure 4:
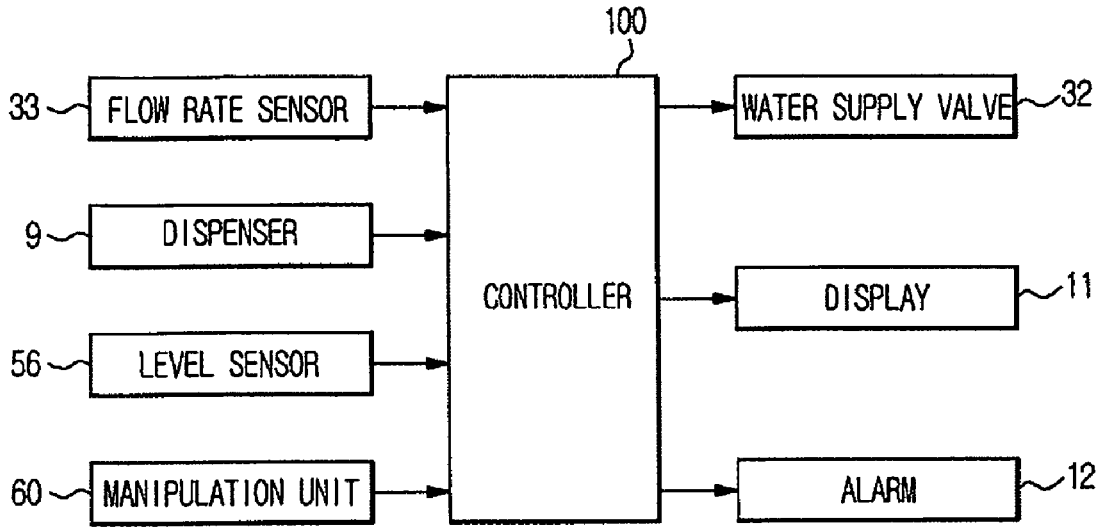
FIG. 4 is a block diagram illustrating a control of a refrigerator according to an embodiment of the present invention.

As illustrated in FIG. 4, a controller 100 that controls the operations of the components is provided in the refrigerator. The flow rate sensor 33, the dispenser 9, the level sensor 56, and a manipulation unit 60 in which a button selecting the operation modes of the refrigerator such as an automatic water discharging mode, in which a water discharging operation is automatically performed, and a manual water discharging mode, in which a water discharging operation is performed by the operation of the user, are provided in the input end of the controller 100.

The water discharging valve 32, the display 11 that visually displays the temperatures of the freezer compartment and the refrigerator compartment and a signal that informs the user that the water collecting tray needs to be taken in and out, and an alarm 12 that audibly displays a signal that informs the user that the level of the water in the water collecting tray reaches a predetermined degree together with the display 11, are provided in the output end of the controller 100.

Hereinafter, the operation of the refrigerator according to the embodiments of the present invention and a method of controlling the refrigerator will be described with reference to the attached drawings.

Figure 5:
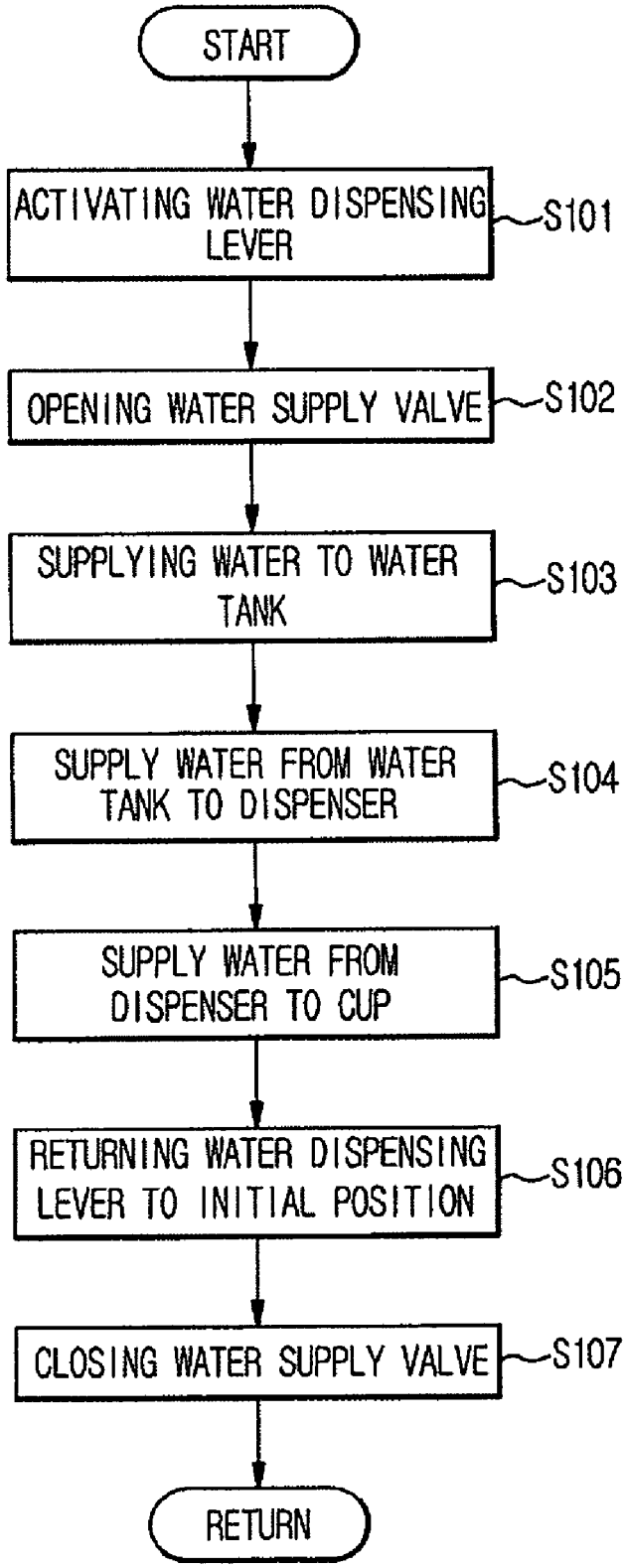
FIG. 5 is a flowchart illustrating an operation of discharging water from a dispenser of a refrigerator according to an embodiment of the present invention to a cup.

In the normal operation of the user taking out the water, as illustrated in FIG. 5, when the user presses the water dispensing lever 15 with a cup to activate the water dispensing lever 15 (S101), the water supply valve that controls the first water supply pipe 36 is opened (S102) so that the water is supplied from the water source to the water tank 19 (S103).

As described above, due to the supply of the new water, the water previously accommodated in the water tank 19 is guided by the second water supply pipe to flow to the dispenser (S104).

Then, the water that reaches the dispenser is dispensed into the cup that presses the water dispensing lever 15 (S105). When the user takes the cup off the water dispensing lever 15, the water dispensing lever 15 is returned to the initial position (S106). Therefore, the water supply valve 32 is closed so that the supply of the new fresh water is stopped (S107).

However, when the water dispensing operation is not performed for a long time, the water accommodated in the water tank 19 must be discharged in order to keep the water fresh.

Figure 6:
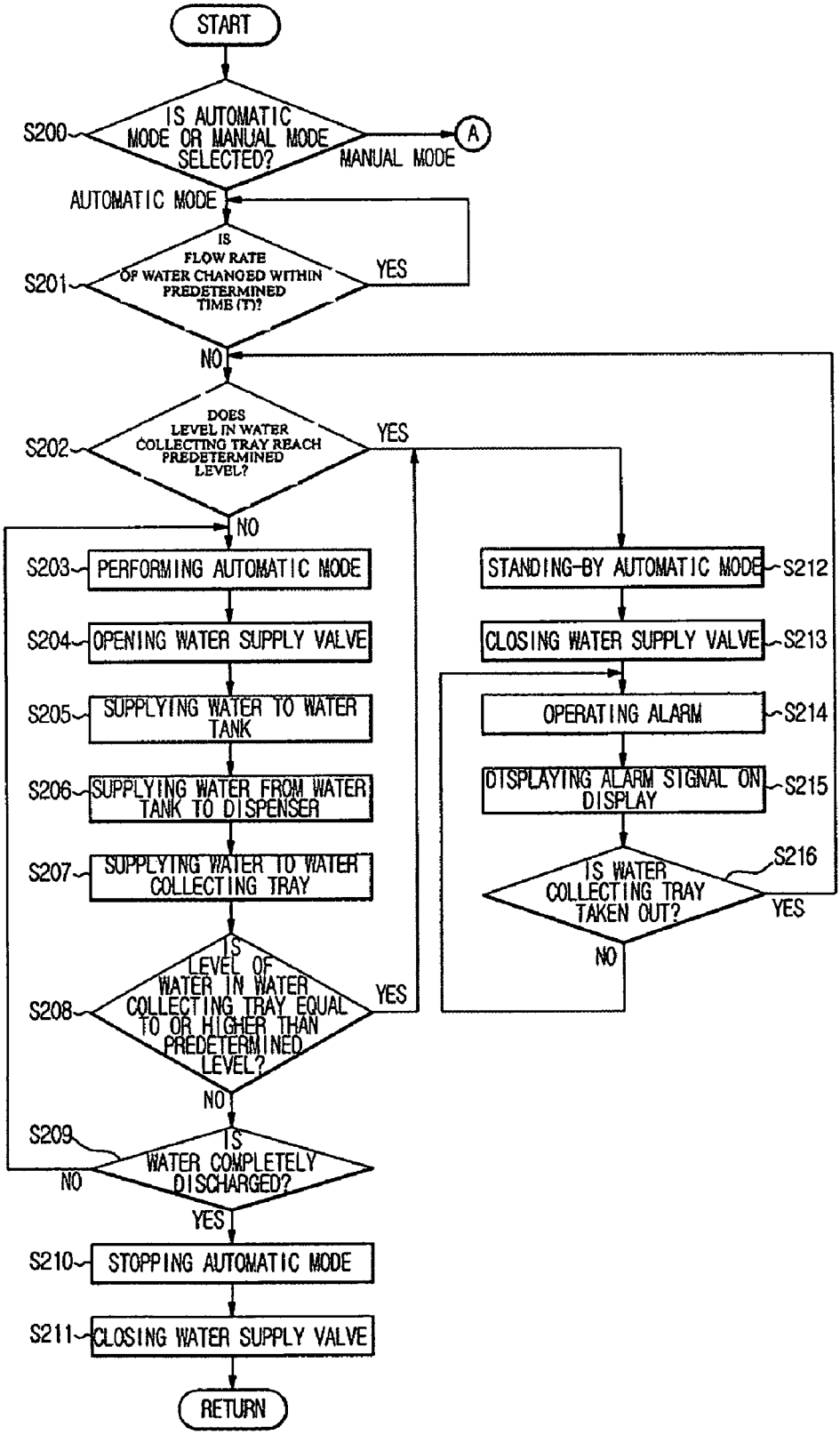
FIGS. 6 and 7 are flowcharts illustrating an operation of discharging the water accommodated for a predetermined time from the refrigerator according to the embodiment of the present invention.
Figure 7:
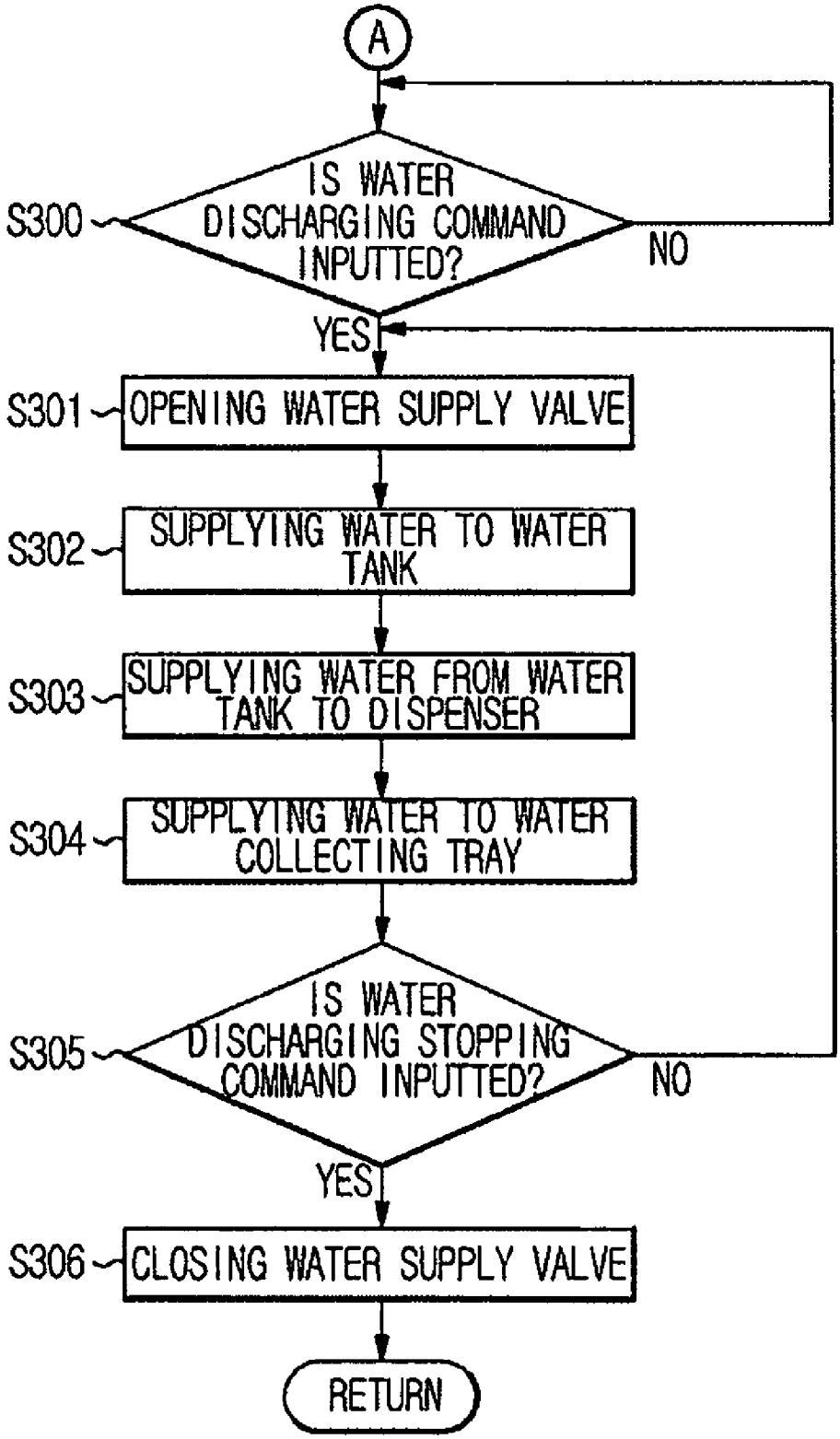

As illustrated in FIG. 6, the operation of the refrigerator having the water collecting tray will be described. It is determined whether the user selects the automatic water discharging mode or the manual water discharging mode (S200). When the automatic water discharging mode is selected, a change in the flow rate of the supplied water is measured within a set time T (S201). When there is no change, it is determined whether the level of the water in the water collecting tray is equal to or higher than a predetermined level (S202).

When the level of the water in the water collecting tray is lower than the predetermined level, the dispenser and the water supply valve operate in the automatic water discharging mode (S203). First, the water supply valve is opened so that the new fresh water is supplied to the water tank 19 (S204 and S205). Therefore, the water previously accommodated in the water tank 19 is supplied to the dispenser 9 (S206). The water supplied to the dispenser 9 is discharged and is guided by the guide pipe to be supplied to the water collecting tray 52 (S207).

Then, it is determined whether the level of the water contained in the water collecting tray 52 is equal to or higher than the predetermined level (S208). When the level of the water contained in the water collecting tray 52 is equal to or higher than the predetermined level, the automatic water discharging mode is stopped until the water collecting tray is empty (S212).

However, if the level of the water in the water collecting tray 52 is lower than the predetermined level, it is determined whether the water to be discharged, that is, the previously accommodated water is completely discharged (S209). When the previously accommodated water is completely discharged, the automatic water discharging mode is stopped and the water supply valve 32 is closed so that the discharging of the water accommodated for a long time are completed (S210 and S211).

However, when the level of the water in the water collecting tray is equal to or higher than the predetermined level before the water is discharged or while the water is being discharged, the automatic water discharging mode is not performed and it is in a stand-by state (S212) and the water supply valve 32 is closed (S213).

Then, in order to inform the user that the level of the water in the water collecting tray 52 is full, the alarm 12 is operated to generate an audible signal (S214) and the display 11 displays that the level of the water in the water collecting tray 52 is full (S215).

Moreover, it is determined whether the user takes out the water collecting tray 52 (S216). When the water collecting tray 52 is taken out, the alarming operations of the alarm 12 and the display 11 are stopped. When the water collecting tray 52 is mounted again, the level in the water collecting tray 52 is determined. When the water collecting tray 52 is empty, the automatic water discharging mode is performed to discharge the water.

On the other hand, the manual water discharging mode is determined during the operation of determining whether the automatic water discharging mode or the manual water discharging mode is operated (S200), it is determined whether the user manipulates the manipulating unit 60 (See FIG. 4) to input a water discharging command (S300). If the user inputs the command, the water supply valve 32 is opened (S301) to supply the new fresh water to the water tank 19 (S302) and the previously accommodated water pushed by the newly supplied water, passes through the dispenser (S303), and is supplied to the water collecting tray 52 (S304), sequentially. It is determined whether a stopping command is inputted (S305), the water supply valve 32 is closed to stop the discharge of the water when the stopping command is inputted (S306).

Figure 8:
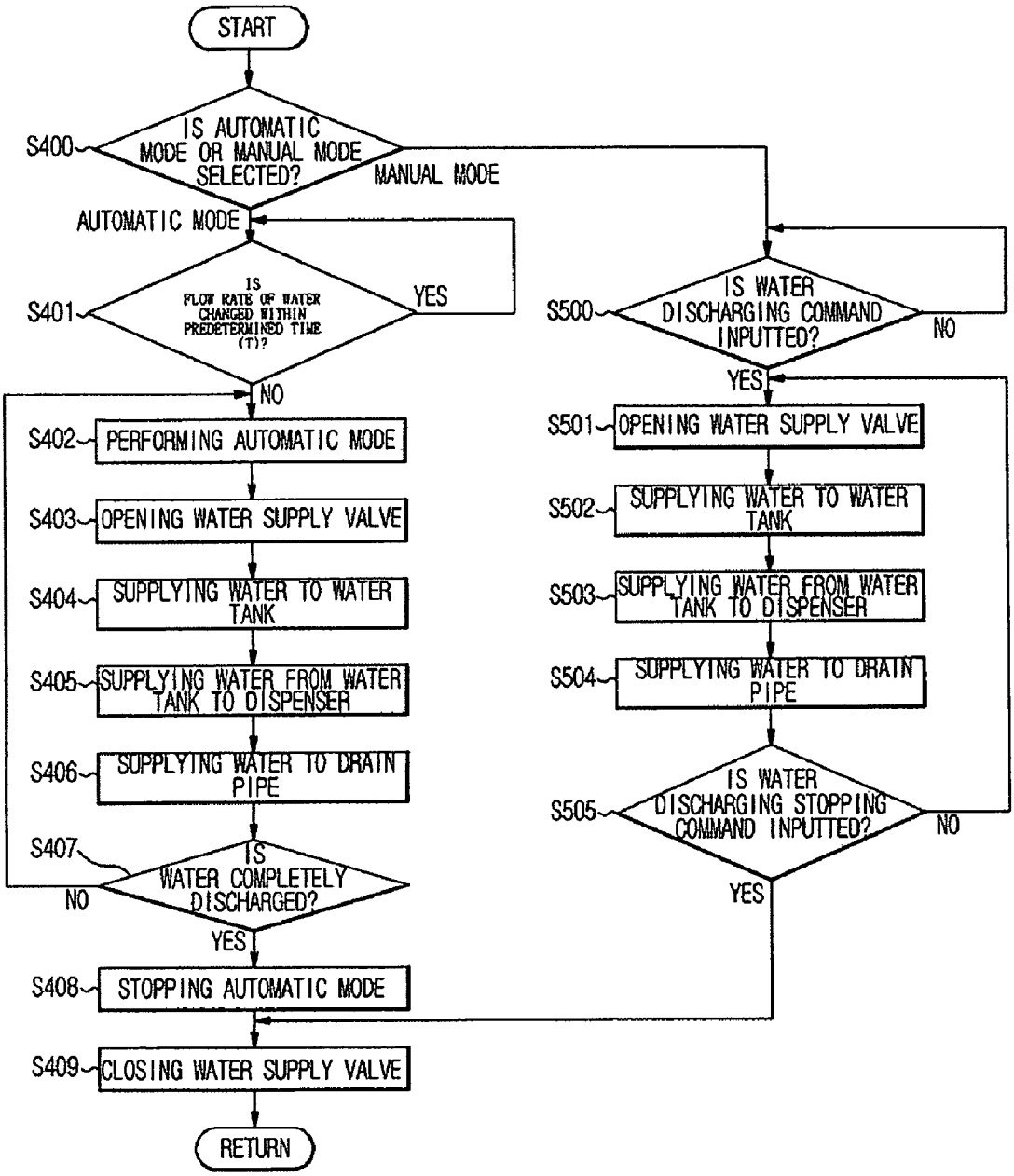
FIG. 8 is a flowchart illustrating an operation of discharging the water accommodated for a predetermined time from a refrigerator according to another embodiment of the present invention.

FIG. 8 illustrates a control of the refrigerator according to another embodiment of the present invention without the water collecting tray. Since there is no water collecting tray 52 (See FIG. 2) as described in the previous embodiment of the present invention, the operation of determining whether the level of the water in the water collecting tray and the alarming operation according to the determination will be omitted.

Therefore, when the automatic/manual water discharging mode is determined (S400) and the automatic water discharging mode is selected, it is determined whether there is a change in the flow rate of the supplied water (S401). If not, the automatic water discharging mode is performed to open the water supply valve such that the new fresh water is supplied to the water tank and the previously accommodated water is discharged to the drain hole via the dispenser and the drain pipe (S402 to S406).

It is determined whether the discharge of the water is completed (D407), if so, the automatic water discharging mode is stopped (S408) and the water supply valve is closed (S409).

On the other hand, in the manual water discharging mode, it is determined whether the water discharging command is inputted (S500). If inputted, the water supply valve is opened to supply the new fresh water to the water tank and the previously accommodated water is discharged to the drain hole via the dispenser and the drain pipe (S501 to S504). It is determined whether the stopping command is inputted (S505). If the stopping command is inputted, the water supply valve is closed to stop the discharge of the water (S409).

As described above, according to the present invention, the problem that water is not discharged but is inevitably accommodated in the water tank for a long time due to a long time absence of a user and/or a long time of nonuse of the dispenser can be solved.

Therefore, relatively fresh water that is standing less than a predetermined time can be dispensed to the user at any time, so that the freshness of the water can be maintained.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

a main body;

a door pivotally mounted to the main body;

a dispenser provided in the door to dispense water to an exterior of the refrigerator;

a water tank connected to the dispenser to accommodate the water;

a water supply valve connected to the water tank to control a flow of the water to be supplied to the water tank; and a controller connected to the water supply valve and the dispenser to control the water supply valve and to discharge the water to the exterior when the water is accommodated in the water tank for a predetermined time.

2. The refrigerator according to claim 1, further comprising a guide pipe provided at a lower side of the dispenser to guide the water to be discharged from the dispenser.

3. The refrigerator according to claim 2, further comprising a water collecting tray provided at a lower side of the main body and connected to the dispenser through the guide pipe to collect the water discharged from the dispenser.

4. The refrigerator according to claim 2, further comprising a water collecting container at an upper side of the guide pipe to receive the water discharged from the dispenser, and a lower side of the water collecting container is connected to the guide pipe.

5. The refrigerator according to claim 2, wherein the guide pipe is provided in the door.

6. The refrigerator according to claim 1, further comprising:

a water source provided outside the main body to supply the water into the main body;

a water supply pipe provided in the main body to connect the dispenser, the water tank, and the water source to each other; and a flow rate sensor provided in the water supply pipe and connected to the controller to detect whether the water flows in the water supply pipe and measure a flow rate of the water.

7. The refrigerator according to claim 3, further comprising a level sensor provided in the water collecting tray to detect a level of the water accommodated in the water collecting tray.

8. The refrigerator according to claim 7, further comprising an alarm connected to the controller to generate an alarm signal when the level of the water accommodated in the water collecting tray is equal to or higher than a predetermined level.

9. The refrigerator according to claim 7, further comprising a display connected to the controller to display an alarm signal when the level of the water accommodated in the water collecting tray is equal to or higher than a predetermined level.

10. The refrigerator according to claim 2, further comprising a drain pipe provided in the main body to be connected to the guide pipe and to a drain hole formed at the exterior of the refrigerator.

11. A method of controlling a refrigerator comprising a dispenser, a water tank connected to the dispenser to accommodate water, and a water supply valve to supply water to the water tank, the method comprising:

determining how long the water is accommodated by detecting a change of a flow rate of the water accommodated in the water tank; and discharging the water to exterior of the refrigerator when the water is accommodated for a predetermined time.

12. The method of controlling a refrigerator according to claim 11, further comprising:

determining a level of the water discharged to a water collecting tray to collect the water discharged from the dispenser; and stopping the discharge of the water when the determined level of the water reaches a predetermined level.

13. The method of controlling a refrigerator according to claim 12, further comprising alarming a user that the level of the water is equal to or higher than the predetermined level when the level of the water discharged to the water collecting tray reaches the predetermined level.

14. The method of controlling a refrigerator according to claim 13, further comprising: determining whether the user takes out the water collecting tray;

stopping the alarming when the water collecting tray is taken out; and continuing the alarming when the water collecting tray is not taken out.

15. The method of controlling a refrigerator according to claim 11, further comprising determining a level of the water accommodated in a water collecting tray to collect the water discharged from the dispenser; and when the determined level of the water is less than a predetermined level, activating the water supply valve to supply new water equal to a quantity of the discharged water such that the previously accommodated water is discharged by the new water.

16. The method of controlling a refrigerator according to claim 15, further comprising determining whether the discharge of the water is complete, and stopping the discharge of water is stopped and closing the water supply valve when the discharge of the water is completed.

17. The method of controlling a refrigerator according to claim 11, further comprising: determining whether an automatic water discharging mode or a manual water discharging mode is selected prior to the determining how long the water is accommodated, the determining how long the water is accommodated and the discharging of the water are performed when the automatic water discharging mode is selected, and discharging the water to the exterior until a stopping command is inputted when the manual water discharging mode is selected.

* * * * *